US011270813B2

(12) United States Patent
Shi

(10) Patent No.: US 11,270,813 B2
(45) Date of Patent: Mar. 8, 2022

(54) HIGH-SPEED TRANSMISSION LINE

(71) Applicant: Dongguan SinHo Technology Co., LTD., Dongguan (CN)

(72) Inventor: Han Shi, Dongguan (CN)

(73) Assignee: DONGGUAN SINHO TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 16/950,251

(22) Filed: Nov. 17, 2020

(65) Prior Publication Data

US 2021/0398709 A1 Dec. 23, 2021

(30) Foreign Application Priority Data

Jun. 22, 2020 (CN) ..... 202010575783.1

(51) Int. Cl.

| | |
|---|---|
| ***H01B 7/08*** | (2006.01) |
| ***H01B 7/00*** | (2006.01) |
| ***H01B 7/04*** | (2006.01) |
| ***H01B 7/17*** | (2006.01) |
| ***H01B 13/22*** | (2006.01) |
| ***H01B 7/02*** | (2006.01) |

(52) U.S. Cl.

CPC ..... *H01B 7/0823* (2013.01); *H01B 7/0045* (2013.01); *H01B 7/0275* (2013.01); *H01B 7/04* (2013.01); *H01B 7/17* (2013.01); *H01B 13/22* (2013.01); *H01B 7/08* (2013.01); *H01B 7/0838* (2013.01); *H01B 7/0861* (2013.01)

(58) Field of Classification Search

CPC ..... H01B 7/04; H01B 7/17; H01B 7/0823; H01B 7/0045; H01B 7/0275; H01B 13/22; H01B 7/08; H01B 7/0838; H01B 7/0861

USPC ..... 174/110 R, 113 R, 117 R, 117 F, 117 FF

See application file for complete search history.

(56) References Cited

U.S. PATENT DOCUMENTS

| | | | | | |
|---|---|---|---|---|---|
| 3,612,744 | A * | 10/1971 | Thomas | H01B 11/20 | 174/36 |
| 3,757,029 | A * | 9/1973 | Marshall | H01B 7/08 | 174/36 |
| 4,382,236 | A * | 5/1983 | Suzuki | H01P 3/085 | 333/1 |
| RE31,477 | E * | 12/1983 | Marshall | H01B 11/00 | 174/115 |
| 4,639,693 | A * | 1/1987 | Suzuki | H01B 7/0838 | 174/117 F |
| 7,399,929 | B2 * | 7/2008 | Ueno | H01B 7/0861 | 174/117 A |
| 7,429,702 | B2 * | 9/2008 | Kobayashi | H05K 1/0219 | 174/117 FF |
| 7,868,254 | B2 * | 1/2011 | Matsushita | H01B 7/0861 | 174/117 FF |
| 8,338,709 | B2 * | 12/2012 | Kodama | H01B 7/0838 | 174/11 OR |
| 2010/0130054 | A1 * | 5/2010 | Le | H01B 7/0861 | 439/502 |

* cited by examiner

*Primary Examiner* — William H. Mayo, III
(74) *Attorney, Agent, or Firm* — Sinorica LLC

(57) ABSTRACT

A high-speed transmission line includes a first shielded layer, a first insulating layer, a conductor layer, a second insulating layer and a second shielded layer sequentially attached to each other. The conductor layer includes plural first conductors and plural first conductors interspersed with each other, and the first conductor has a round cross section and is made of a round copper wire.

4 Claims, 9 Drawing Sheets

HIGH-SPEED TRANSMISSION LINE

FIELD OF THE INVENTION

The present invention relates to the technical field of cables, and more particularly to a high-speed transmission line.

BACKGROUND OF THE INVENTION

A transmission line of a flexible cable, also known as cable, is a novel signal cable made of an insulating material and a very thin flat copper wire and produced by a lamination process conducted in a high-tech automated equipment production line, and such cable is soft, freely bendable or foldable, thin, small in size, and quick to cool, so that the transmission line is used extensively in electronic products such as computers, printers, etc.

For servers, high-speed data transmissions are greatly required, and data lines such as coaxial cables are generally used for the data transmissions of the servers. However, such cables have the disadvantages of large volume, slow cooling, and inconvenient to use. Therefore, the subject of how to increase the data transmission speed of the transmission line and applying the advantages of the transmission line to the servers demands immediate attention and feasible solutions.

SUMMARY OF THE INVENTION

In view of the aforementioned drawbacks of the prior art, the present invention provides a high-speed transmission line with a first conductor in form of a round copper wire capable of increasing the transmission speed of signals and extending the scope of application of the transmission line of a flexible cable.

To achieve the aforementioned and other objectives, the present invention discloses a high-speed transmission line comprising a first shielded layer, a first insulating layer, a conductor layer, a second insulating layer and a second shielded layer sequentially attached to each other, and the first shielded layer is coupled to the second shielded layer via signals, and the conductor layer comprises a plurality of first conductors spaced apart from each other, and the first conductor has a cross section in a circular shape.

Preferably, the conductor layer further comprises a plurality of second conductors, and the second conductor has a cross section in a rectangular shape, and the plurality of second conductors is interspersed with the plurality of first conductors.

Preferably, the first conductor comprises a first front portion, a first middle portion and a first rear portion sequentially coupled to each other, and the first middle portion is wrapped between the first insulating layer and the second insulating layer, and both of the first front portion and the first rear portion are exposed from the first insulating layer and the second insulating layer; and the second conductor comprises a second front portion, a second middle portion and a second rear portion sequentially coupled to each other, and the second middle portion is wrapped between the first insulating layer and the second insulating layer, and both of the second front portion and the second rear portion are exposed from the first insulating layer and the second insulating layer.

Preferably, the first front portion and/or the first rear portion of at least one first conductor comprise a first shielded conductor and a second shielded conductor, and the first shielded conductor is coupled to the second shielded conductor signal; and the first shielded conductor and the first shielded layer signal are coupled via signals or the second shielded conductor and the second insulating layer are coupled via signals.

Preferably, the second front portion and/or the second rear portion of at least one second conductor comprise a third shielded conductor and a fourth shielded conductor, and the third shielded conductor is coupled to the fourth shielded conductor via signals; and the third shielded conductor is coupled to the first shielded layer via signals or the fourth shielded conductor is coupled to the second insulating layer via signals.

Preferably, the high-speed transmission line further comprises a protective case with an electrically conductive inner surface and an insulating outer surface, and the protective case is sheathed on the outer surfaces of the first shielded layer and the second shielded layer, and both of the first shielded layer and the second shielded layer are coupled to the inner surface of the protective case via signals.

Preferably, the first shielded layer has an upper conducting portion, and the second shielded layer has a lower conducting portion, and both of the upper conducting portion and the lower conducting portion are coupled to the inner surface of the protective case via signals.

Preferably, both of the first shielded layer and the second shielded layer are aluminum foil composite layers.

Preferably, the first conductor is made of a tin plated copper wire, a silver plated copper wire or a naked copper wire, and the second conductor is made of a tin plated copper wire, a silver plated copper wire, or a naked copper wire.

Preferably, the protective case is made of an aluminum foil mylar, a silver plated aluminum foil mylar, or a copper plated aluminum foil mylar.

The present invention has the following advantageous effects:

The first conductors of the conductor layer used in the high-speed transmission line of the present invention are round copper wires capable of reducing the capacitive effect of the conductor layer to increase the data transmission speed. Compared to a flat copper wire, the round copper wire can increase the signal transmission speed significantly, so as to apply the advantages of the high-speed transmission line to servers or in servers and extend the scope of application of the transmission line of a flexible cable. Compared to a cable, the transmission line has a better cooling effect that makes the servers or the operation of the servers more stable. In addition, the round copper wire does not have any angular edges, and thus provides a better lamination effect between the first insulating layer and the second insulating layer.

BRIEF DESCRIPTION OF NUMERALS USED IN THE DRAWINGS

1: First shielded layer; 11: Upper conducting portion; 2: First insulating layer; 3: Second insulating layer; 4: Second shielded layer; 5: First conductor; 51: First front portion; 52: First middle portion; 53: First rear portion; 54: First shielded conductor; 55: Second shielded conductor; 6: Second conductor; 61: Second front portion; 62: Second middle portion; 63: Second rear portion; 64: Third shielded conductor; 65: fourth shielded conductor; and 7: Protective case.

DESCRIPTION OF THE PREFERRED EMBODIMENTS

To make it easier for our examiner and people having ordinary skill in the art to understand the objective of the invention, its structure, innovative features, and performance, we use preferred embodiments together with the attached drawings for the detailed description of the invention. It is intended that the embodiments and drawings disclosed herein are to be considered illustrative rather than restrictive.

Figure 1:
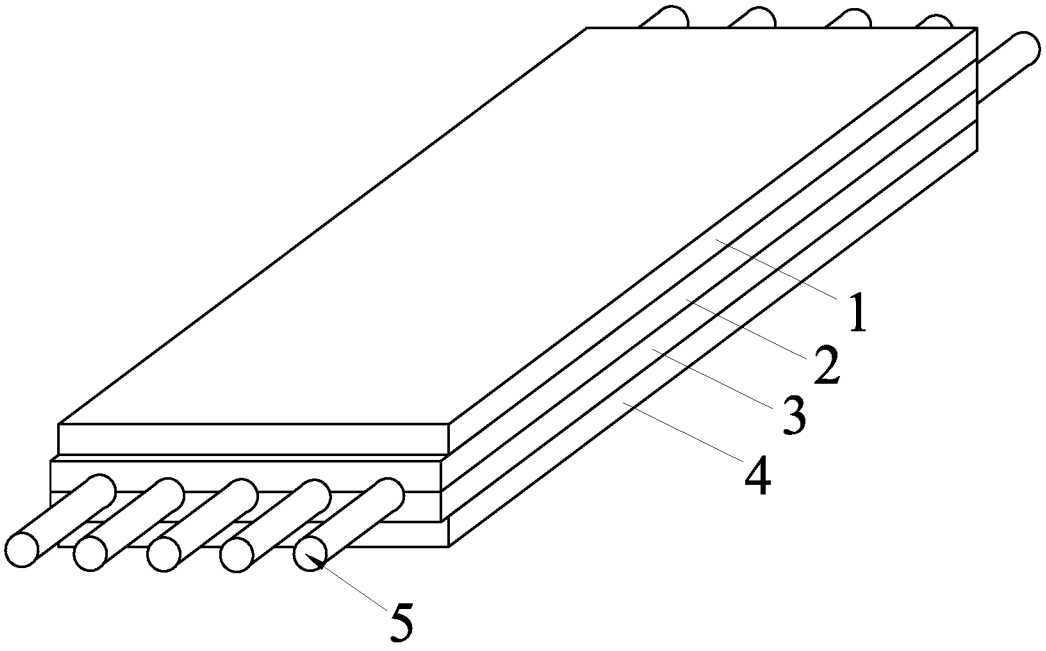
FIG. 1 is a schematic structural view of the present invention.
Figure 2:
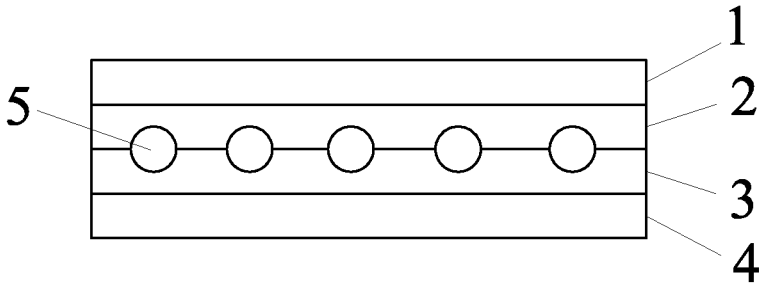
FIG. 2 is a front view of FIG. 1.

With reference to FIGS. 1 and 2 for a high-speed transmission line of an embodiment of the present invention, the high-speed transmission line comprises a first shielded layer 1, a first insulating layer 2, a conductor layer, a second insulating layer 3 and a second shielded layer 4 sequentially attached to each other, and the first shielded layer 1 and the second shielded layer 4 are coupled via signals, and the conductor layer comprises a plurality of first conductors 5 spaced apart from each other, and the first conductor 5 has a cross section in a circular shape. Preferably, the first conductor 5 is made of a tin plated copper wire, a silver plated copper wire or a naked copper wire. Wherein, the first shielded layer 1 is attached to the first insulating layer 2 by a hot melt adhesive or a self-adhesive, and the second shielded layer 4 is attached to the second insulating layer 3 by a hot melt adhesive or a self-adhesive, and both of the first insulating layer 2 and the second insulating layer 3 are attached to the conductor layer by a hot melt adhesive. Of course, any equivalent adhesive other than the hot melt adhesive and self-adhesive can be used to achieve the same attachment effect for the structure of the transmission line of a flexible cable.

Specifically, the first conductor 5 of the conductor layer is a round copper wire capable of reducing the capacitive effect of the conductor layer to increase the data transmission speed. Compared to the flat copper wire, the round copper wire can increase the transmission speed of signals significantly, so as to achieve the effects of applying a high-speed transmission line to a server, extending the scope of application of the transmission line of the flexible cable, providing a better cooling effect to the transmission line than the cable, making a server or the operation of the server more stable, avoiding angular edges by round copper wires, and giving a better lamination of the first insulating layer 2 and the second insulating layer 3.

Preferably, the first shielded layer 1 and the second shielded layer 4 are made of a material with low dielectric constant such as an aluminum foil composite material and capable of reducing the dielectric constant between the conductor layer to the first shielded layer 1 or the second shielded layer 4, so as to further reduce the capacitive effect between the first conductors 5, provide a very high speed data transmission, and decrease the heat generated among the first shielded layer 1, the first insulating layer, the conductor layer, the second insulating layer and the second shielded layer 4. In this embodiment, the transmission line provides a better cooling function while maintaining the existing high speed data transmission function, and thus the transmission line of the invention is suitable for devices such as servers.

Figure 3:
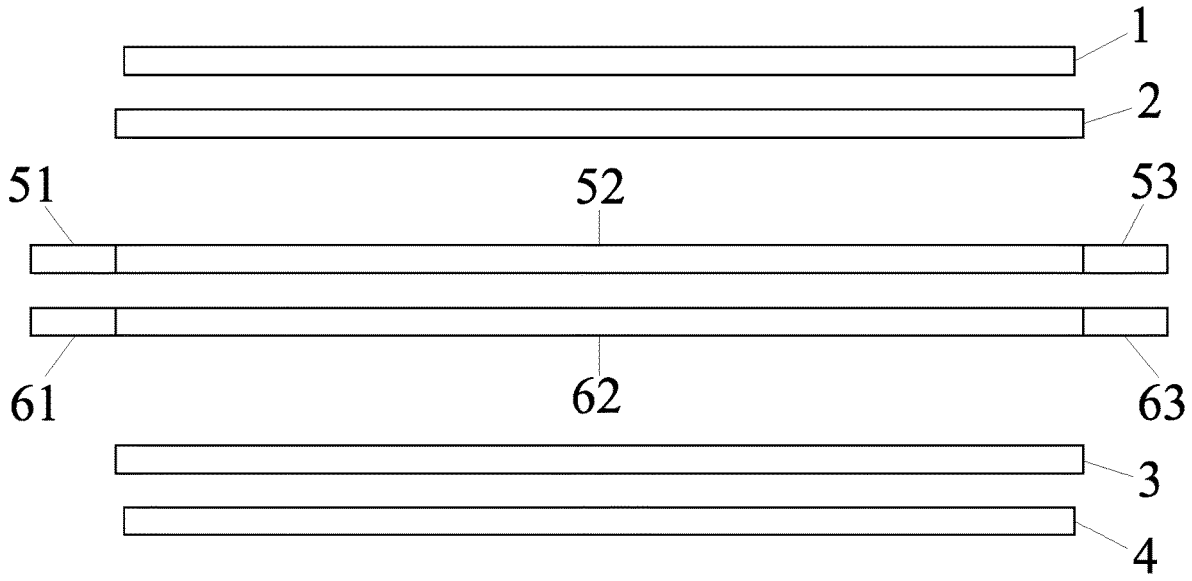
FIG. 3 is a schematic view of the disassembled structure of the present invention.
Figure 4:
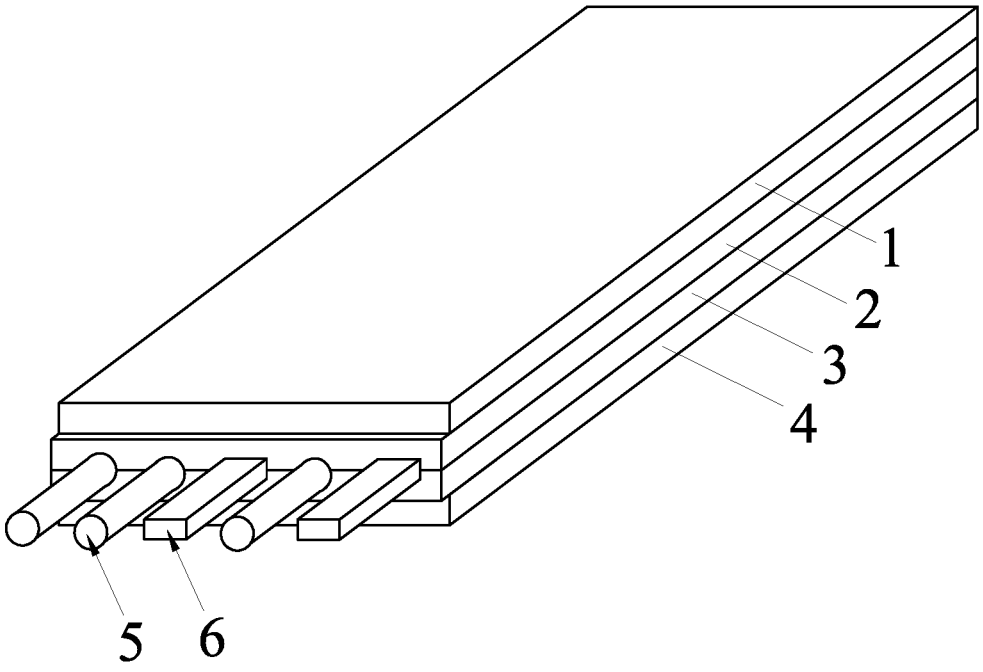
FIG. 4 is a schematic view of the structure with a first conductor and a second conductor of the present invention.

With reference to FIGS. 3 and 4 for a high-speed transmission line of this embodiment, the conductor layer further comprises a plurality of second conductors 6 with a cross section in a rectangular shape, and the plurality of second conductors 6 and the plurality of first conductors 5 are interspersed with each other. Preferably, the second conductor 6 is made of a tin plated copper wire, a silver plated copper wire or a naked copper wire.

Specifically, the round first conductors 5 and the flat second conductors 6 are interspersed with each other, and the order of their arrangement is determined according to the actual product. In fact, every first conductor 5 and every second conductor 6 transmit different signals, and the signal transmission of some electronic products involves a high speed and a normal speed, so that it is inappropriate to design all conductor layers as the round first conductors 5 or as the flat second conductors 6. The combined structure with the conductor layer designed as the first conductor 5 and the second conductor 6 can meet different product requirements.

With reference to FIGS. 1, 3 and 4 for a high-speed transmission line of this embodiment, the first conductor 5 comprises a first front portion 51, a first middle portion 52 and a first rear portion 53 sequentially coupled to each other, and the first middle portion 52 is wrapped between the first insulating layer 2 and the second insulating layer 3, and both of the first front portion 51 and the first rear portion 53 are exposed from the first insulating layer 2 and the second insulating layer 3; the second conductor 6 comprises a second front portion 61, a second middle portion 62 and a second rear portion 63 sequentially coupled to each other, and the second middle portion 62 is wrapped between the first insulating layer 2 and the second insulating layer 3, and both of the second front portion 61 and the second rear portion 63 are exposed from the first insulating layer 2 and the second insulating layer 3.

Specifically, both ends of the first conductor 5 and the second conductor 6 are exposed to the outside without touching the first insulating layer 2 and the second insulating layer 3. In a conventional transmission line of a flexible cable, the conductive wire is exposed from one side, so that the conventional transmission line of the flexible cable of this kind usually requires a corresponding connector to be connected to a circuit board or a product. As a result, it is necessary to produce the corresponding connector for the use of the transmission line of the flexible cable. In the high-speed transmission line of this invention, both ends of the first conductor 5 and the second conductor 6 are exposed directly and can be soldered onto the circuit board directly without requiring the connector. Therefore, the invention provides a more convenient application and lowers the production cost by omitting the connector.

In a high-speed transmission line of this embodiment as shown in FIGS. 5 to 9, the first front portion 51 and/or the first rear portion 53 of at least one first conductor 5 comprise a first shielded conductor 54 and a second shielded conductor 55, and the first shielded conductor 54 and the second shielded conductor 55 are coupled to each other via signals; and the first shielded conductor 54 is coupled to the first shielded layer 1 via signals or the second shielded conductor 55 is coupled to the second insulating layer via signals.

When the second conductor 6 is installed, the second front portion 61 and/or the second rear portion 63 of at least one second conductor 6 comprise a third shielded conductor 64 and a fourth shielded conductor 65, and the third shielded conductor 64 and the fourth shielded conductor 65 are coupled to each other via signals; the third shielded conductor 64 is coupled to the first shielded layer 1 via signals or the fourth shielded conductor 65 is coupled to the second insulating layer via signals.

Figure 8:
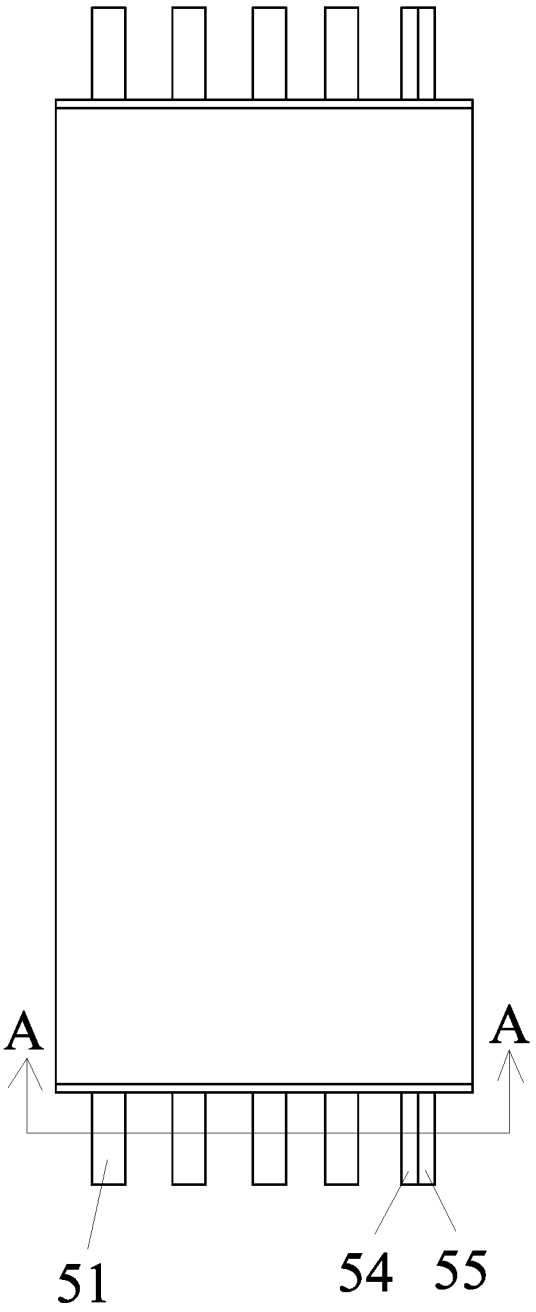
FIG. 8 is a schematic view of the structure of a first shielded conductor and a second shielded conductor of the present invention.
Figure 9:
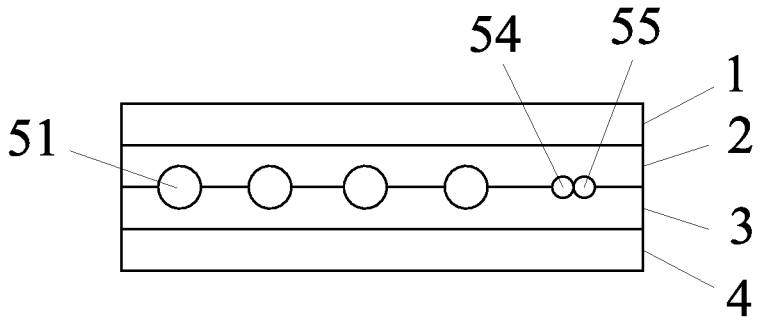
FIG. 9 is a cross-sectional view of Section A-A of FIG. 8.

Specifically, the first conductor 5 of this high-speed transmission line has a first shielded conductor 54 and a second shielded conductor 55 configured to be parallel to each other or configured to be relative to each other (rather than parallel to each other) in order to improve the EMI resistance (or electromagnetic shielding effect), and the first conductor 5 such as the one as shown in FIGS. 8 and 9 just needs to couple the first shielded conductor 54 and the second shielded conductor 55 with each other via signals, and any one of the first shielded conductor 54 and the second shielded conductor 55 is coupled to the first shielded layer 1 or the second shielded layer 4 via signals.

In this embodiment, both of the first shielded layer 1 and the second shielded layer 4 are aluminum foil composite layers. Polyethylene terephthalate (PET) or polyester resin on a surface of the first shielded layer 1 and the second shielded layer 4 is burned and removed by laser to expose the aluminum layer. In other words, an upper conducting portion 11 and a lower conducting portion (not labelled in the figure) are the exposed aluminum layers, and then the first shielded conductor 54 or the second shielded conductor 55 are bent back, such that the first shielded conductor 54 or the second shielded conductor 55 is contacted with the exposed aluminum layer to achieve a signal connection effect. Finally, a protective case 7 is sheathed on the first shielded layer 1 and the second shielded layer 4, wherein the protective case 7 is made of aluminum foil mylar, silver plated aluminum foil mylar, or copper plated aluminum foil mylar, so that the protective case 7 has an electrically conductive inner surface and an insulating outer surface to achieve the function of coupling the first shielded layer 1 to the second shielded layer 4 via signals. In the meantime, the first shielded conductor 54 or the second shielded conductor 55 and the exposed aluminum layer are protected in the protective case 7, and the inner surface of the protective case 7 is attached with the first shielded conductor 54, the second shielded conductor 55, or the exposed aluminum layer to ensure a normal contact of the first shielded conductor 54 or the second shielded conductor 55 with the aluminum layer.

Figure 5:
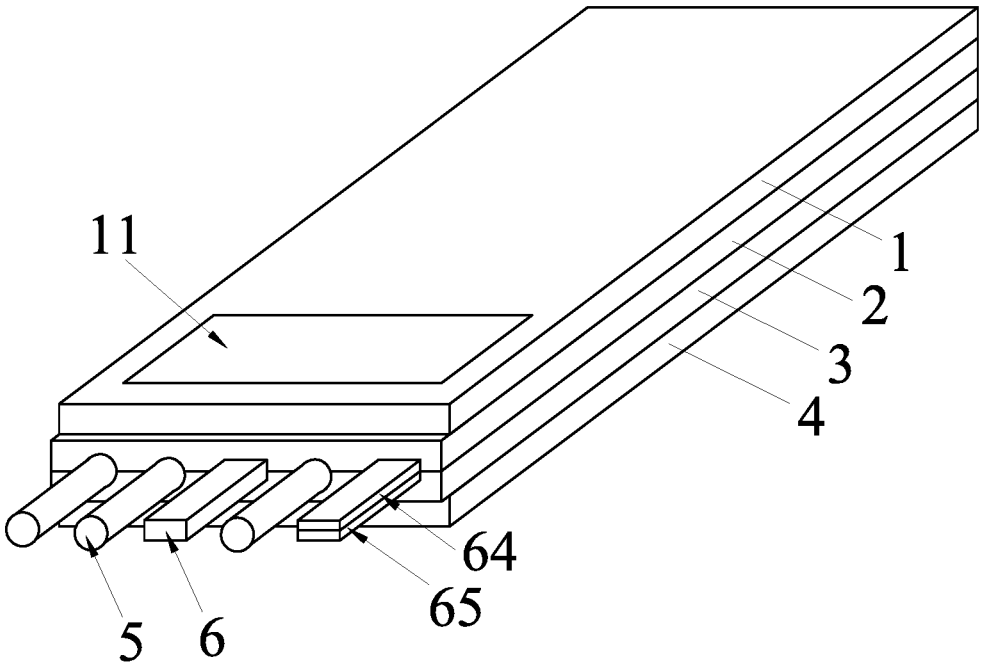
FIG. 5 is a schematic view of the structure with a third shielded conductor, a fourth shielded conductor and an upper conducting portion of the present invention.
Figure 6:
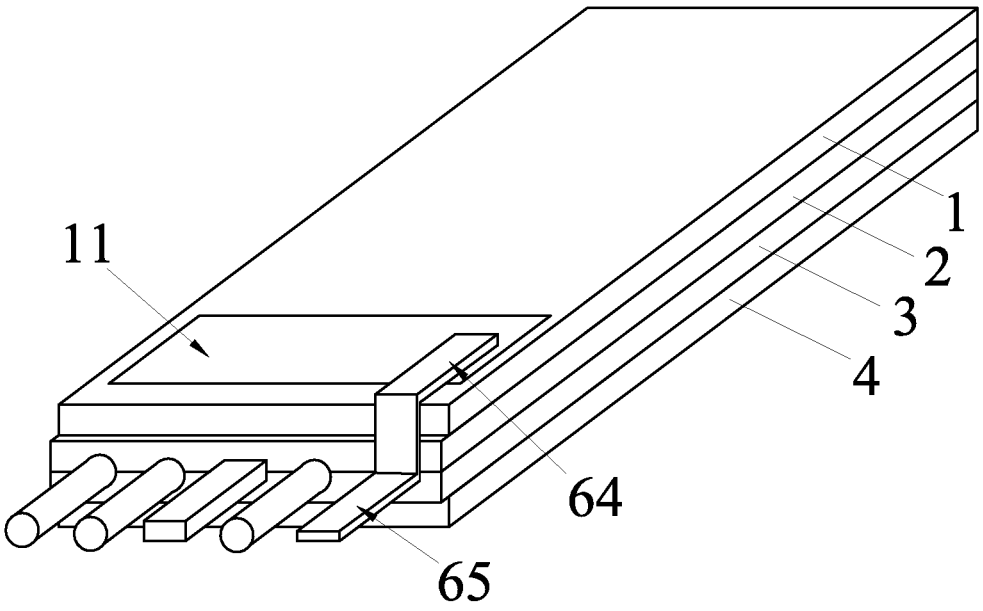
FIG. 6 is a schematic view of the structure of stacked conductors coupled to an upper conducting portion of the present invention.
Figure 7:
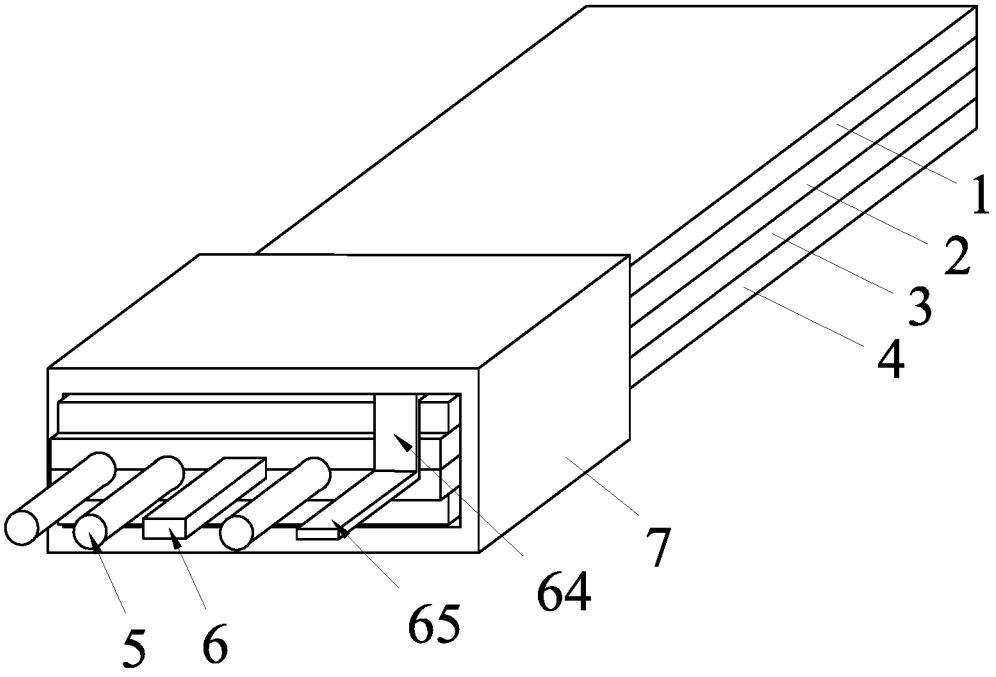
FIG. 7 is a schematic view of the structure of a protective case of the present invention.

Of course, when the second conductor 6 is installed, a third shielded conductor 64 and a fourth shielded conductor 65 can also be installed on the second conductor 6, wherein the third shielded conductor 64 and the fourth shielded conductor 65 are stacked with each other as shown in FIGS. 5 to 7 or configured to have a positional relation other than the stacked relation, such that the third shielded conductor 64 and the fourth shielded conductor 65 can be coupled to each other via signals. The third shielded conductor 64 and the fourth shielded conductor 65 are provided to achieve the same method and effect as those of the first shielded conductor 54 and the second shielded conductor 55, and the EMI resistance of these shielded conductors of the transmission line of this embodiment can be enhanced to give a more stable use of the transmission line of the flexible cable and improve the stability of the signal transmission of the product.

In addition, the first shielded conductor 54, the second shielded conductor 55, the third shielded conductor 64 and the fourth shielded conductor 65 may be arranged with a quantity of one or more according to actual requirements.

While the invention has been described by means of specific embodiments, numerous modifications and variations could be made thereto by those skilled in the art without departing from the scope and spirit of the invention as set forth in the claims.

What is claimed is:

1. A high-speed transmission line, comprising a first shielded layer, a first insulating layer, a conductor layer, a second insulating layer and a second shielded layer sequentially attached to each other, and the first shielded layer being coupled to the second shielded layer via signals, characterized in that;

the conductor layer comprises a plurality of first conductors spaced apart from one another, and the first conductor has a cross section in a circular shape;

the conductor layer further comprises a plurality of second conductors, and the second conductor has a cross section in a rectangular shape, and the plurality of second conductors is interspersed with the plurality of first conductors;

the first conductor comprises a first front portion, a first middle portion and a first rear portion sequentially coupled to each other, and the first middle portion is wrapped between the first insulating layer and the second insulating layer, and both of the first front portion and the first rear portion are exposed from the first insulating layer and the second insulating layer;

the first front portion and/or the first rear portion of at least one of the first conductors comprises a first shielded conductor and a second shielded conductor coupled to each other via signals; the first shielded conductor is coupled to the first shielded layer via signals, or the second shielded conductor is coupled to the second insulating layer via signals; and the high-speed transmission line further comprises a protective case with an electrically conductive inner surface and an insulating outer surface, and the protective case is sheathed on the outer surfaces of the first shielded layer and the second shielded layer, and both of the first shielded layer and the second shielded layer are coupled to the inner surface of the protective case via signals.

2. The high-speed transmission line as claimed in claim 1, wherein the second conductor comprises a second front portion, a second middle portion and a second rear portion sequentially coupled to each other, and the second middle portion is wrapped between the first insulating layer and the second insulating layer, and both of the second front portion and the second rear portion are exposed from the first insulating layer and the second insulating layer.

3. The high-speed transmission line as claimed in claim 2, wherein the second front portion and/or the second rear portion of at least one of the second conductors comprise a third shielded conductor and a fourth shielded conductor coupled to each other via signals; and the third shielded conductor is coupled to the first shielded layer signal or the fourth shielded conductor is coupled to the second insulating layer via signals.

4. The high-speed transmission line as claimed in claim 1, wherein the first shielded layer has an upper conducting portion, and the second shielded layer has a lower conducting portion, and both of the upper conducting portion and the lower conducting portion are coupled to the inner surface of the protective case via signals.

* * * * *